United States Patent [19]

Conant

[11] 4,381,849

[45] May 3, 1983

[54] SOLIDS-LIQUID SLURRY SEPARATING CENTRIFUGE

[75] Inventor: Lawrence D. Conant, West Bridgewater, Mass.

[73] Assignee: Bird Machine Company, Inc., South Walpole, Mass.

[21] Appl. No.: 278,081

[22] Filed: Jun. 29, 1981

[51] Int. Cl.[3] ..... B04B 1/20

[52] U.S. Cl. ..... 494/43; 494/43; 494/84

[58] Field of Search ..... 233/7, 8, 9, 6, 3, 27, 233/46, 28

[56] References Cited

U.S. PATENT DOCUMENTS

| | | | |
|---|---|---|---|
| 775,320 | 11/1904 | Van Kirk . | |
| 2,867,378 | 1/1959 | Harlow | 233/7 |
| 3,143,504 | 8/1964 | Schneider | 233/7 |
| 3,379,368 | 4/1968 | Gilreath | 233/7 |
| 3,734,399 | 5/1973 | Oas | 233/7 |
| 4,303,192 | 12/1981 | Katsume | 233/7 |

OTHER PUBLICATIONS

Centrifuge Placed in Public Use and/or on Sale in the U.S. by Bird Machine Company, Inc., prior to Jun. 29, 1980.

*Primary Examiner*—Robert W. Jenkins
*Attorney, Agent, or Firm*—Edgar H. Kent

[57] ABSTRACT

A solids-liquid slurry separating centrifuge has a rotary bowl, a conveyor rotatable coaxially therein, an outlet for solids, and a liquids outlet permitting retention in the bowl of a pool of slurry with an inner surface at or close to the axis of the bowl. Mechanism for discharging solids from the solids outlet includes a frusto-conical inner portion of the bowl and a coaxial frusto-conical hub on the conveyor within it having their smaller ends at the solids outlet, the hub being formed to a larger cone angle than the bowl portion such that the outlet end of the passage between them is wider than its inlet end and is approximately equal in cross-sectional area to the passage inlet. The hub has a conveyor blade helix of diminishing spacing between turns from the larger diameter end toward the smaller diameter end of the passage.

8 Claims, 4 Drawing Figures

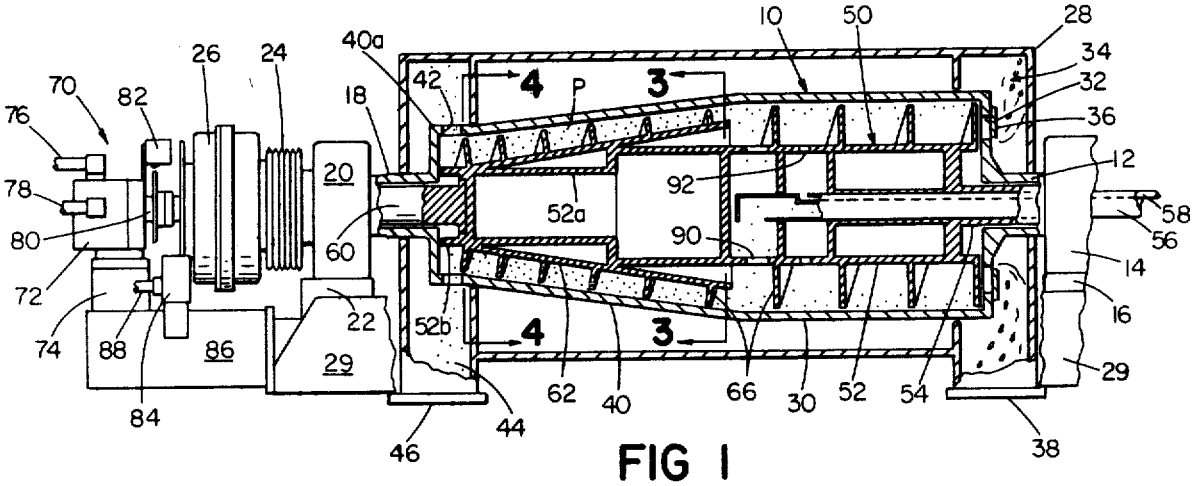
FIG 1
FIG 2
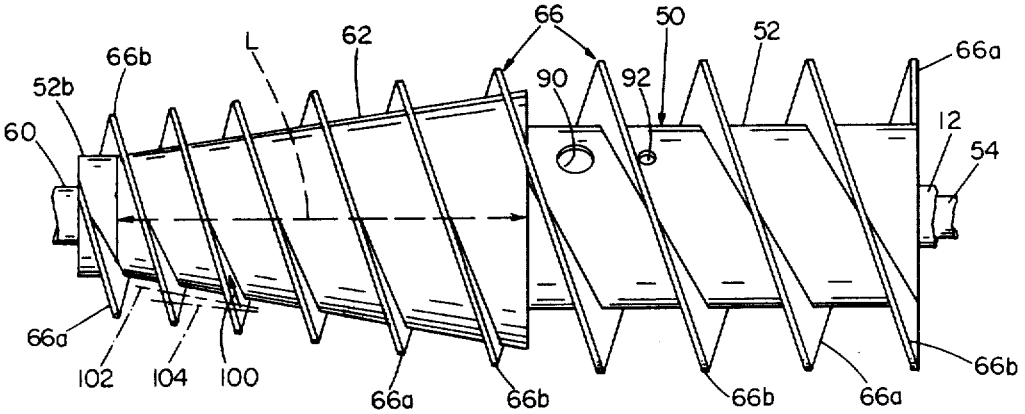
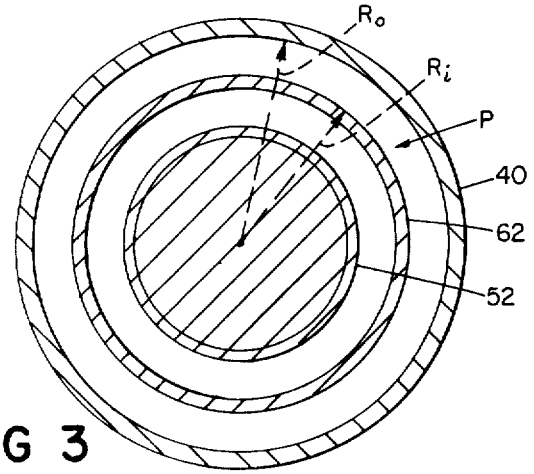
FIG 3
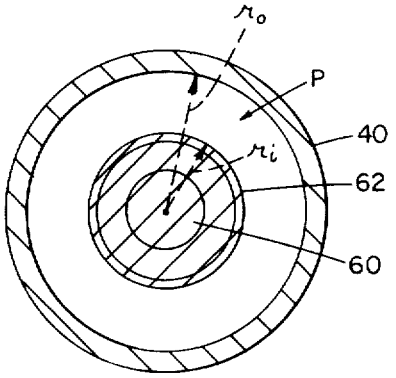
FIG 4

SOLIDS-LIQUID SLURRY SEPARATING CENTRIFUGE

BACKGROUND OF THE INVENTION

This invention relates to solids-liquid separating centrifuges which have a rotary bowl, a rotary conveyor mounted coaxially therein and means for rotating the bowl and conveyor about their common axis in the same direction at a differential speed. More particularly, the invention relates to solids discharge mechanism for such a centrifuge and to the provision of such mechanism which is particularly useful where hydraulic assist is used in conveying difficult to convey solids to a solids outlet.

Centrifuges of the type concerned normally discharge the solids through a frusto-conical interior of an end portion of the bowl, defining an outlet at its smaller end which may be a series of apertures in its wall. The solids discharge mechanism comprises this bowl end portion and a bladed hub on the conveyor extending therein to convey the solids to the outlet. The bowl interior preceding the larger end of its frusto-conical end portion may itself be frusto-conical, a continuation of its said end portion, or may, more usually, be cylindrical. The conveyor preceding the hub portion may be a cylindrical helically bladed hub or cage.

In order to convey the solids through the frusto-conical interior of the bowl end portion, some of the prior art has proposed utilizing a frusto-conical hub having a smaller cone angle than the passage in which it fits, as in U.S. Pat. Nos. 775,320 and 3,379,368. In such a construction the passage between the hub and the bowl end interior diminishes in width and cross-sectional area, and therefore in capacity, to its smaller end, and thus has a tendency to plug, particularly if the hub is provided with a conveyor blade helix of diminishing pitch (distance between centers of successive complete turns) toward the outlet, as in U.S. Pat. No. 775,320 aforesaid. U.S. Pat. No. 3,379,368 seeks to avoid such plugging by providing a blade helix of increasing pitch toward the outlet.

U.S. Pat. No. 3,143,504 forms the inner, frusto-conical hub at a larger cone angle than the conically shaped bowl end within which it fits, so that the passage between them diverges to an outlet end which, as shown, has a larger transverse cross-sectional area than the inlet. The blade has an increasing pitch toward the discharge end, as is shown by increasing distance between the blade turns.

A more recent commercial centrifuge of the prior art uses an inner cone with a larger cone angle than that of the bowl end cone within which it fits, but selects the cone angles such that the progressive increase in width of the passage between the cones from inlet to outlet substantially offsets the progressive decrease in diameter, so that the cross-sectional area of the passage at its outlet end approximately equals the cross-sectional area at the inlet. The cross-sectional area of the passage is accordingly substantially the same throughout its length (there is a small enlargement in the middle unless one of the cones is formed to a curved generatrix to offset it). The blade helix has a constant pitch. This mechanism operates satisfactorily with readily conveyable solids to produce acceptably dry solids outputs or "cakes". However, in treating sludges containing a large proportion of soft, slimy solids which are essentially non-conveyable by the blade helix, "hydraulic assist" of a deep slurry pool in the bowl, having its inner surface nearly as close or even closer to the centrifuge axis than the solids outlet, is needed to apply hydraulic pressure at the inlet sufficient to force such solids through the helix. With such sludges and hydraulic assist, difficulty has been experienced in producing a discharge cake of acceptable dryness.

SUMMARY OF THE INVENTION

The object of this invention is to improve the solids discharge mechanism of the recent prior art centrifuge as described above to enable it to produce drier cakes from slurries with a high content of difficult to convey solids needing hydraulic assist, without, however, detracting from the advantages of the mechanism applied to conveyable solids.

It has been discovered that this object is attained by providing the hub of this mechanism with a blade helix in which the pitch decreases, instead of being constant, from the inlet end toward the outlet end of the solids discharge passage, other features of the mechanism being retained. The distance between successive blade turns of the helix thus decreases toward the outlet, instead of remaining constant as it would if the pitch of the blade were kept constant. This decreasing distance between turns is substantially offset by the increasing depth of the passage toward the outlet end, so that the cross-sectional area and volume between blades stay substantially constant, whereas they increase toward the outlet end with a blade helix of constant pitch. In preferred embodiments, the tangent angle of the blade helix (defined as the angle between a tangent to the helix and the generatrix of either of the two frusto-conical surfaces between which it is disposed) is held substantially constant. This results in the desired diminishing blade pitch with diminishing diameter of such surfaces.

Thus, the invention is applied to a solids-liquid separating centrifuge having a rotary bowl, a rotary conveyor mounted coaxially therein, means for rotating the bowl and conveyor about their common axis in the same direction at a differential speed and means for feeding a solids liquid slurry into the bowl. The centrifuge also has an outlet for solids at an end portion of the bowl, and a separate outlet for liquid from the bowl constructed and arranged to permit the formation in the bowl of a slurry pool having its surface at least approximately as close to the bowl axis as the solids outlet. According to the invention, mechanism is provided for discharging solids through the bowl end portion to the solids outlet comprising a frusto-conical interior in the bowl end portion having its smaller diameter end at the solids outlet, a frusto-conical, helically bladed hub on the conveyor located coaxially within, and extending substantially the full length of, the frusto-conical bowl interior and having a larger cone angle than such interior such as to define therewith a frusto-conical passage which, at its smaller diameter end, is wider than at its larger diameter end and is approximately equal in cross-sectional area to its larger diameter end, the hub of the solids discharge mechanism being helically bladed by at least one helically extending blade mounted on the hub so that the helix defined thereby has a diminishing spacing between successive turns thereof about the common axis from the larger diameter end to the smaller diameter end of the frusto-conical passage in which it lies.

With such a helix substituted, it has been found that cake moisture of slurries predominantly of solids needing hydraulic assist is substantially reduced at equal solids throughput, while, with conveyable solids, performance is at least equal to the prior mechanism in all respects. The improvement in moisture reduction enables greater throughputs to meet cake moisture specifications or the meeting of such specifications which could not otherwise be satisfied.

The reasons for the improved operation are not fully understood. Since the centrifuge with constant pitch helix has a wetter cake output than that of the centrifuge according to the invention, the latter will operate at lower differential speed of conveyor to bowl for given throughput. This provides a longer solids dwell time in the centrifuge bowl and in the discharge helix, which may be a factor. The constant pitch helix produces a cross-sectional area and volume between turns which increase in the direction of the outlet due to the increasing width of the passage. With the diminishing pitch helix, these remain essentially constant and the conveyor operates full, whereas with the constant pitch helix, the turns near the outlet are partly empty. This difference may be a factor, and also difference in the axial component of conveying velocity produced by the two helices. However, in operation on slurries predominantly of blade-conveyable solids, these differences do not appear to be significant, since both centrifuges operate on such slurries at the same differential to produce cake of comparable moisture content at the same throughput.

For most advantageous utilization of the invention, the centrifuge should be equipped with an adjustable differential speed drive of the conveyor relative to the bowl while the centrifuge is operating, such as is provided by a variable speed "backdrive" for the conveyor connected to speed change gearing between the bowl and conveyor. Such backdrives are in common use and examples are shown in U.S. Pat. Nos. 2,867,378 and 3,734,399.

BRIEF DESCRIPTION OF THE DRAWING

In the accompanying drawing:

FIG. 1 is a view, partly in vertical cross-section, partly in side elevation, of a centrifuge with partially shown hydraulic backdrive and with solids discharge mechanism according to the invention;

FIG. 2 is an enlarged plan view of the centrifuge conveyor shown in FIG. 1;

FIG. 3 is an enlarged cross-section view taken on line 3—3 of FIG. 1 with the blade helix omitted; and FIG. 4 is a similar view to FIG. 3 on line 4—4 of FIG. 1.

DESCRIPTION OF THE PREFERRED EMBODIMENT

Referring to FIG. 1, the centrifuge bowl designated generally 10 has fixed to its right-hand end flange a sleeve shaft 12 rotatable in bearing mount 14 fixed to support pedestal 16, and at the other end a second sleeve shaft 18 extending rotatably through bearing mount 20 fixed to support pedestal 22. Sleeve shaft 18 has fixed thereto a drive pulley 24 which is rotated by belts (not shown) from a motor (not shown). Also fixed to shaft 18 and rotated thereby is the cover of gear box 26 which has mounted on the interior thereof ring gears (not shown) of a speed change gearing assembly (not shown) mounted in gear box 26. Bowl shafts 12 and 18 extend rotatably through the ends of an enclosing casing 28 of the centrifuge bowl, which is supported at its bottom by a base plate 29 which may be supported by short posts (not shown) on the area floor (not shown).

Bowl 10 has a cylindrical end portion 30 having ports 32 in its end wall through which the effluent liquid is discharged into a compartment 34 in the corresponding end of casing 28, over the usual adjustable weir plates 36, the setting of which determines the level of the pool of slurry maintained in bowl 10. Compartment 34 has an outlet 38 at its bottom for connection to discharge piping (not shown). The other end portion 40 of the bowl is frusto-conical, and contains outlet ports 42 in a less tapered end extension **40*a* through which the solids are discharged into a compartment 44 in the adjacent end of casing 28. Compartment 44 discharges the solids through bottom outlet 46** to connected piping or other conveying device (not shown).

The centrifuge conveyor, designated generally 50, has a cylindrical body 52, with a smaller diameter extension **52*a* at one end. A sleeve shaft 54, fixed to the larger diameter end of body 52, is rotatably journaled in sleeve shaft 12 of bowl 10 and rotatably surrounds a stationary slurry feed pipe 56 connected to an outside feed tank (not shown), feed pipe 56 in turn containing a small diameter, stationary flocculant feed pipe 58 connected to an outside source of flocculant (not shown). A shaft 60, fixed to extension 52*a* and surrounded by a cylindrical flange 52*b* extending from extension 52*a*, extends rotatably through and beyond bowl sleeve shaft 18 and is secured at its outer end to the drive gear of the speed change drive gearing in casing 26**, so that the conveyor is rotated coaxially with the bowl in the same direction at a small differential to the speed of the bowl, in the instance shown, a small speed reduction.

A frusto-conical hub 62 is mounted on the extension **52*a* of conveyor body 52 and on the adjacent end of the large diameter portion of conveyor body 52, with its larger open end lying at the juncture of cylindrical portion 30 and frusto-conical portion 40 of bowl 10. A conveying blade helix, designated generally 66, is mounted on the surface of conveyor body 52 at its larger end and on the surfaces of hub 62 and cylindrical flanges 52*b*** to extend continuously the full length of the bowl.

Also partially illustrated in FIG. 1 is a differential speed control mechanism, designated generally 70, the control mechanism selected for partial illustration being commercially available from applicant's assignee Bird Machine Company, Inc., of South Walpole, Mass., under the name "Bird Hydraulic Backdrive". As shown, a casing 72 on support pedestal 74 contains hydraulic motor/pumps (not shown) having pressure fluid connections 76, 78 to a control cabinet and sump (not shown). These motor/pumps control the speed of a shaft 80 fixed to the first stage pinion gear of the speed reduction gearing in casing 26, decreasing the relative bowl to conveyor speed by positively rotating shaft 80, and increasing such relative speed by acting as a brake to slow the speed of shaft 80. An electromagnetic detector 82 in conjunction with a magnetic spot disc on shaft 80 times the rotation of shaft 80 and provides this information to the control cabinet. A timer 84 on extension 86 of base plate 29 is connected to a sprocket on the end of the rotating cover of gear box 26 and provides speed (bowl speed) information to the control cabinet via hydraulic connection 88.

In operation of the apparatus so far described, with the bowl and conveyor rotating in the same direction (clockwise as viewed from the right-hand end of FIG. 1), feed slurry is discharged from the end of feed pipe 56 into a compartment in conveyor body 52 from which it discharges into the bowl through outlets 90 in the body wall. Flocculant, when used, is discharged from the end of flocculant feed pipe 58 into another compartment in conveyor body 52, separated by a baffle from the feed compartment, and discharges into the slurry fed to the bowl through outlets 90 by way of outlets 92 in the conveyor body wall.

The solids settling in the bowl are moved by the conveyor blade helix from right to left in FIG. 1, through the cylindrical portion 30 of bowl 10 and through the passage between frusto-conical bowl portion 40 and hub 62 out apertures 42 into casing compartment 44. The non-settling liquid or effluent fraction flows out through openings 32 and past weir plates 36 into casing compartment 34. It should be noted that weir plates 36 are shown at their setting for maximum slurry pool retention in the bowl, this being with the surface of the pool slightly closer to the bowl axis than are the inner faces of solids discharge outlets 42. Thus, the solids are given maximum hydraulic assist in moving through the discharge passage between bowl portion 40 and hub 62, and the drawing contemplates a slurry of substantially non-conveyable solids, needing such assist.

The differential speed control mechanism may be manually set to a predetermined value and thereafter automatically adjusted to compensate for feed fluctuations, for example, by torque sensing and/or speed sensing mechanism, or may be left to manual supervision and control.

Now more particularly describing those aspects of the machine which the invention most directly concerns, as earlier stated, the cone angle to which the frusto-conical bowl portion 40 is formed and the larger cone angle to which hub 62 is formed are such that the cross-sectional area at right angles to the axis of the passage between them P (FIG. 1), at its larger diameter inlet end (FIG. 3), is approximately equal to such cross-sectional area of the passage at its smaller diameter outlet end (FIG. 4). Thus, the angles are such that the outer radius $R_o$ (FIG. 3) of the inlet end of passage P (which is the inner radius of cylindrical section 30 of the bowl) its inner radius $R_i$ (FIG. 3), the outer radius of the smaller diameter end of the passage $r_o$ (FIG. 4) and its inner radius $r_i$ (FIG. 4) are such that $R_o^2-R_i^2=r_o^2-r_i^2$, or approximately has this relationship. As can be seen in FIG. 1, the arrangement provides passage P with a generally constantly increasing width from the inlet to the outlet end thereof. The cone angle of bowl extension 40*a* is small, as shown about 3°. The term "cone angle" as used herein refers to the acute angle between the axis and the generatrix.

Blade helix 66, which may be formed of one, two or more blades, is shown as formed of two helical blades 66*a* and 66*b* (FIG. 2), starting from ends at the right-hand end of FIG. 2 spaced 180° apart about the conveyor body axis with their turns intervening each other, being mounted on conveyor body 52 up to hub 62, then on hub 62 and cylinder 52*b*. The pitch of each blade 66*a* and 66*b* is therefore twice the pitch of blade helix 66. As can be seen from FIGS. 1 and 2, the height of the blades is such as to provide close clearance with the bowl throughout. Therefore, their height is greatly reduced at their intersection with the large diameter end of hub 62 and from there is progressively increased in conformity with the increasing width of passage P toward its outlet end.

Conveyor blades 66*a* and 66*b* are shown as mounted at about a 90° angle to the conveyor axis, but this is not essential. However, in accordance with the invention, the pitch of the portion of helix 66 which is mounted on hub 62 progressively diminishes from the larger toward the smaller diameter end of the hub, as can be seen from FIGS. 1 and 2. Preferably, the blade has a substantially constant tangent angle, that is, a tangent to the helix on hub 62, as represented by the arrow 100 in FIG. 2, makes a substantially constant angle at all portions of the helix either with a line parallel to the generatrix of the surface of hub 62, represented by dash line 102 in FIG. 2, or with a line parallel to the generatrix of the inner surface of bowl portion 40, represented by the dash line 104 in FIG. 2. Maintaining such relationship insures that the diminishing distance between turns of the blade helix due to diminishing pitch is approximately such as to offset the increasing width of passage P, to provide a substantially constant cross-sectional area and volume between turns.

In designing a discharge mechanism according to the invention, the cone angle of the frusto-conical bowl part and its length may be selected according to the usual criteria, which may vary with maximum diameter and length of bowl desired and the nature of the product to be treated. These criteria will include the maximum depth of slurry pool it is desired to maintain in the bowl for settling and/or for hydraulic assist purposes, particularly since the invention is most advantageous with solids needing hydraulic assist. The axial length of the passage P, indicated by the dash line L in FIG. 2, will then be determined, for any selected cone angle for the bowl portion, as the length at which the diameter at its outlet end will be approximately equal to, or slightly more or less than, the chosen minimum diameter of the inner surface of the pool. It will be apparent that, for any selected maximum pool depth, small bowl cone angles will require qreater lengths L than larger angles. Generally, the cone angle should not be less than 3° nor more than 20° with a range of about 7° to 16° being preferred for purposes of the invention.

With the cone angle for the frusto-conical bowl section determined and with L and both $R_o$ and $r_o$ known, the selection of the cone angle to which hub 62 is generated becomes largely a matter of mathematics and choice, bearing in mind that $R_i$ should provide sufficient width to the inlet end of passage P to readily accommodate maximum contemplated solids throughput, and that the minimum value of $r_i$ is determined by the diameter of structure it will surround. A value may be assumed for one of these radii and the other then calculated by substitution of this and the known values for $R_o$ and $r_o$ in the equation $R_o^2-R_i^2=r_o^2-r_i^2$, thus determining the slope and angle of a cone connecting the two radii. Adjustments in values may then be made if needed to provide a whole number cone angle which will produce at least a close enough approximation (e.g. ±10%) of an exactly equal cross-sectional area relationship.

FIG. 1 indicates a cone angle for bowl section 40 at the low end of the preferred range previously set forth, such as about 8° which was previously employed with the helix in the passage P of constant pitch. However, the diminishing pitch helix according to the invention has been successfully utilized with this angle nearly doubled to 15° with the cone angle of the hub at 20°, desirably considerably reducing length L.

Conveyor blades 66a and 66b may be cut and formed as usual in segments of 90° angular extent. Each segment may be cut to size, inside and outside radii, in an automatic burning machine. The segments are then formed in an hydraulic press which is adjustable to provide variable pitch and therefore provides the successive segments to form the helix on hub 62 with the prescribed diminishing pitch. Finally, the segments are welded together in order and in place on the supporting structure, with the tangent angle of those of the frusto-conical part to the generatrix of either the bowl or the support cones maintained constant, as previously described.

Proper utilization of differential speed control such as the mechanism 70 can increase the advantages derived from solids discharge mechanism according to the invention, particularly when operating at or near maximum pool depth with essentially non-conveyable solids. Thus, on start up, after the desired solids throughput rate at the given feed rate has been obtained, the control is desirably manually adjusted to the smallest rate of rotation of the conveyor relative to the bowl at which that throughput is maintained. This causes the helix, by virtue of its particular construction, to fill, and increases the dwell time of solids in the bowl, resulting in reduction of moisture in the solids cake. Put on automatic control, this relationship can be maintained despite minor temporary feed fluctuations. However, major changes in the volume or the nature of the solids content of the feed may make manual readjustment of the same type desirable.

Various features of the machine shown in FIG. 1 do not have significant bearing on the operation of the solids discharge mechanism according to the invention and may be considered as optional. A cylindrical bowl part in the settling section is considered preferable, but it may be all or in part frusto-conical, such as a continuation of section 40 at the same or a different cone angle. The feed and effluent removal arrangements shown are conventional, of the so-called "counter-current" type, in which effluent flow is opposite to solids conveying. It may, however, be of the "concurrent flow" type, in which the feed would enter the right-hand end of the bowl in FIG. 1 and be removed centrally by an internal scoop connected to discharge piping (see e.g. U.S. Pat. No. 3,279,687), or by tubes in the conveyor returning it to discharge at the right-hand end (see e.g. U.S. Pat. No. 3,268,159). In FIG. 1, the space between the large end of hub 62 and conveyor body 52 which substantially fills with slurry at maximum pool depth, has only small settling function and may be closed by an end plate. Such plate, attached to conveyor body 52, or to a continuation of extension 52a to the right in FIG. 1 to replace the unused left end compartment of body 52, may constitute the supporting structure for the right-hand end of hub 62.

I claim:

1. In a solids-liquid separating centrifuge having a rotary bowl, a rotary conveyor mounted coaxially therein, means for rotating said bowl and conveyor about their common axis in the same direction at a differential speed, means for feeding a solids liquid slurry into said bowl, an outlet for solids at an end portion of said bowl, and a separate outlet for liquid from said bowl constructed and arranged to permit the formation in said bowl of a pool of said slurry having its surface at least approximately as close to the bowl axis as said solids outlet;

solids discharge mechanism for discharging solids through said bowl end portion to said solids outlet comprising a frusto-conical interior in said bowl end portion having its smaller diameter end at said solids outlet, a frusto-conical, helically bladed hub on said conveyor located coaxially within, and extending substantially the full length of, said frusto-conical interior and having a larger cone angle such as to define with said interior a frusto-conical passage which, at its smaller diameter end, is wider than at its larger diameter end and is approximately equal in cross-sectional area to its larger diameter end, said hub being helically bladed by at least one helically extending blade mounted on said hub to define a helix which has a diminishing spacing between successive turns thereof about said common axis from the larger diameter end toward the smaller diameter end of said passage.

2. A centrifuge according to claim 1 wherein the tangent angle of said helix to the generatrix of one of the two opposite walls of said passage is substantially constant.

3. A centrifuge according to claim 2 wherein the cross-sectional area and volume between adjacent turns of said helix are substantially constant.

4. A centrifuge according to claim 1 wherein the cone angle of the exterior wall of said passage is between about 3° and 20°.

5. A centrifuge according to claim 4 wherein said cone angle is between about 7° and 16°.

6. A centrifuge according to any of claims 1 to 5 wherein said helix forms a continuation of a preceding bladed helix on said conveyor.

7. A centrifuge according to claim 6 wherein said preceding bladed helix is generally cylindrical.

8. A centrifuge according to any of claims 1 to 5 wherein means are provided for adjustably varying the rate of rotation of said hub relative to that of said bowl end portion while the centrifuge is operating.

* * * * *